US009770757B2

(12) United States Patent
Wang et al.

(10) Patent No.: US 9,770,757 B2
(45) **Date of Patent: *Sep. 26, 2017**

(54) METHOD OF MAKING SOUND INTERFACE IN OVERCAST BIMETAL COMPONENTS

(71) Applicant: GM Global Technology Operations LLC, Detroit, MI (US)

(72) Inventors: Qigui Wang, Rochester Hills, MI (US); Bing Ye, Minhang (CN); Haiyan Jiang, Minhang (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 197 days.

This patent is subject to a terminal disclaimer.

(21) Appl. No.: 14/825,238

(22) Filed: Aug. 13, 2015

(65) Prior Publication Data

US 2017/0043394 A1 Feb. 16, 2017

(51) Int. Cl.

| | |
|---|---|
| ***B22D 19/00*** | (2006.01) |
| ***B22D 19/16*** | (2006.01) |
| ***B22D 25/06*** | (2006.01) |
| ***C25D 5/44*** | (2006.01) |
| ***C23C 22/66*** | (2006.01) |
| ***C23C 22/78*** | (2006.01) |
| ***C23C 22/83*** | (2006.01) |
| ***C23F 1/36*** | (2006.01) |
| ***B22D 19/04*** | (2006.01) |
| ***B22D 21/00*** | (2006.01) |
| ***C23G 1/02*** | (2006.01) |
| ***C23G 1/12*** | (2006.01) |
| ***C23G 1/22*** | (2006.01) |

(Continued)

(52) U.S. Cl.

CPC ..... *B22D 25/06* (2013.01); *B22D 19/0081* (2013.01); *B22D 19/04* (2013.01); *B22D 21/007* (2013.01); *C23C 18/54* (2013.01); *C23C 22/66* (2013.01); *C23C 22/78* (2013.01); *C23C 22/83* (2013.01); *C23F 1/36* (2013.01); *C23G 1/02* (2013.01); *C23G 1/125* (2013.01); *C23G 1/22* (2013.01); *C23G 1/24* (2013.01); *C25D 5/44* (2013.01); *C25D 5/50* (2013.01); *C25D 3/18* (2013.01)

(58) Field of Classification Search

CPC ..... B22D 19/00; B22D 19/0081; B22D 19/16
USPC ..... 164/75, 98, 100, 101, 102, 103
See application file for complete search history.

(56) References Cited

U.S. PATENT DOCUMENTS 5,259,437 A * 11/1993 Jarry ..... B22D 19/00 164/100
5,293,923 A * 3/1994 Alabi ..... B22D 19/0081 164/100

(Continued)

*Primary Examiner* — Kevin P Kerns

(57) ABSTRACT

A method of forming a bi-metallic casting. The method includes providing a metal preform of a desired base shape defining a substrate surface and removing a natural oxide layer and surface contamination from the substrate surface to yield a cleaned metal preform. The method further includes galvanizing the cleaned metal preform, yielding a galvanized metal preform followed by electroplating a thin nickel film on at least a portion of the substrate surface of the galvanized metal preform. Additionally, the method includes metallurgically bonding the portion of the metal preform having the nickel film with an overcast metal to form a bi-metallic casting. The nickel film promotes a metallurgical bond between the metal preform and the overcast metal.

18 Claims, 3 Drawing Sheets

(51) Int. Cl.

| | |
|---|---|
| ***C23G 1/24*** | (2006.01) |
| ***C25D 5/50*** | (2006.01) |
| ***C23C 18/54*** | (2006.01) |
| *C25D 3/18* | (2006.01) |

(56) References Cited

U.S. PATENT DOCUMENTS

| | | | | |
|---|---|---|---|---|
| 6,474,397 | B1 * | 11/2002 | Gunkel et al. | B22D 19/04 164/100 |
| 9,481,034 | B2 * | 11/2016 | Chen et al. | B22D 19/0081 164/75 |
| 2014/0290894 | A1 | 10/2014 | Chen et al. | |

* cited by examiner

METHOD OF MAKING SOUND INTERFACE IN OVERCAST BIMETAL COMPONENTS

BACKGROUND OF THE INVENTION

The present disclosure relates to methods of forming bi-metallic components for structural applications and, more particularly, to methodologies and technologies to achieving sound metallurgical bonding when liquid aluminum is cast over solid aluminum objects.

This section provides background information related to the present disclosure which is not necessarily prior art.

As vehicle weight reduction continues to be a driver in part design and development, various new strategies are being developed to provide strength at reduced weight. One strategy is the process of casting a light metal such as aluminum or magnesium onto a heavier metal substrate. Overcasting steel or copper with aluminum or magnesium allows one to take advantage of the strength of steel and the corrosion resistance and heat transfer capability of copper without compromising the light weight sought in many applications. Following the substitution of aluminum for ferrous castings in the automotive industry, further innovations involve adopting hybrid solutions where a mix of widely different materials are combined.

For instance, the high mechanical resistance of steel may be allied to the lightness of magnesium to create a hybrid assembly. One such example of a hybrid assembly used in automotive engines achieves weight reduction by casting magnesium over aluminum which, unlike magnesium, resists the corrosive aggression of the cooling fluid. Overcasting can be advantageous in reducing machining cost or enhancing heat transfer, such as by embedding copper pipes in aluminum. Similarly, inserts may be used in aluminum castings to locally enhance their strength, heat transfer properties or wear resistance. Aluminum and magnesium castings offer significant mass savings when compared with ferrous or copper parts. Hollow sections generally are more efficient in reducing mass in a mechanical assembly. These sections may be obtained by overcasting tubes of "heavy" materials with aluminum, which can accommodate the complexity in shape offered by the metal casting process and also meet the strength requirement.

Another example is the overcasting of the preformed conductor bars with aluminum to form the end rings in aluminum induction rotors. Casting single piece aluminum rotor (bars and end rings are all formed by liquid aluminum cast together) poses lot of challenges not only in casting process but also in the aluminum alloys used to make the rotors. Aluminum alloys used to cast rotor squirrel cages are usually high purity aluminum, or electric grade wrought alloys which are all difficult to cast because of their low fluidity, high shrinkage rate (density change from liquid to solid), high melting temperature and short solidification range, etc. These characteristics of the higher purity aluminum alloys increase porosity and the tendency of hot tearing, particularly at the locations where the conductor bars connect to the end rings, which leads to fracture between the conductor bars and the end rings. Furthermore, many cast aluminum squirrel rotor cages are made by high pressure die casting process in order to fill the thin and long bars (squirrel slots) in the laminate steel stack quickly to avoid cold shuts. The entrained air and abundant aluminum oxides produced during the high pressure die casting process, which are due to very high flow velocity (about 60 m/s) in mold filling, can not only decrease rotor quality and durability, but also significantly reduce the thermal and electric conductivity of the rotor, particularly in the conductor bars.

Bi-metallic casting techniques can be used to provide components having increased stiffness, strength, wear resistance, and other functionality. Bi-metallic casting allows two different metals to be combined in one component, while maintaining the distinct advantages offered by the constituent metals and/or alloys. In various bi-metallic casting techniques, at least a portion of base material or preform of a first metal or alloy is overcast with a second metal or alloy. Metal preforms may have an oxide layer or oxide film on their exterior substrate surface. Oxide layers may start as simple amorphous (non-crystalline) layers, such as $Al_2O_3$ on aluminum, MgO on magnesium and Mg—Al alloys, and $Cu_2O$ on copper. In certain aspects, their structures may derive from the amorphous melt on which they nucleate and/or grow and transform into complex and different phases and structures. The oxide layers may interfere with and/or negatively affect the ability of the metal preform to metallurgically bond with another metal under bonding conditions. Further, even if an oxide layer is once removed, there remains the possibility for another oxide layer to re-form under the appropriate oxidizing conditions and parameters. Thus, there remains a need for improved methods of forming even stronger metallurgical bonds between two metals joined using bi-metallic casting techniques.

SUMMARY OF THE INVENTION

The current invention involves methods of forming bi-metallic castings by forming a thin nickel film on at least a portion of a substrate surface of a metal preform and overcasting a second metal.

According to an aspect of the present invention, a method of forming a bi-metallic casting is provided. The method includes providing a metal preform of a desired base shape defining a substrate surface and removing a natural oxide layer and surface contamination from the substrate surface, yielding a cleaned metal preform. The method further includes galvanizing the cleaned metal preform, yielding a galvanized metal preform and then electroplating a thin nickel film on at least a portion of the substrate surface of the galvanized metal preform. Further, the method includes metallurgically bonding the portion of the metal preform having the nickel film with an overcast metal to form a bi-metallic casting, wherein the nickel film promotes a metallurgical bond between the metal preform and the overcast metal.

According to another aspect of the present invention, a method of forming a bi-metallic casting with improved bonding between metal components is provided. The method includes providing an aluminum preform of a desired base shape defining a substrate surface. Further, the method includes removing a natural oxide layer from the substrate surface, etching the substrate surface, and galvanizing the substrate surface. Additionally, the method includes electroplating a thin nickel film on the substrate surface. Further, the method includes preheating the aluminum preform to 150° C. to 350° C. followed by forming a metallurgical bond between at least a portion of the aluminum preform and an overcast metal having a composition different from both the aluminum preform and the nickel film. The nickel film promotes the metallurgical bond between the aluminum preform and the overcast metal.

According to yet another aspect of the present invention, a method of forming a bi-metallic casting with an aluminum preform is provided. The method includes removing a natural oxide layer from a surface of an aluminum preform. Additionally, the method includes immersing the aluminum preform into a galvanizing bath followed by electroplating a thin nickel film having a thickness of less than about 5 μm on the surface of the aluminum preform. Further, the method includes preheating the aluminum preform to 150° C. to 350° C. followed by contacting at least a portion of the aluminum preform with a molten aluminum heated to between 680° C. and 740° C. to form a bi-metallic casting. The nickel film substantially remains on the surface of the aluminum preform as an interface promoting a metallurgical bond between the aluminum preform and the molten aluminum.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The following detailed description of the preferred embodiments of the present invention can be best understood when read in conjunction with the following drawings.

DETAILED DESCRIPTION OF THE PREFERRED EMBODIMENT

Example embodiments will now be described more fully with reference to the accompanying drawing.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The present technology enhances methods of forming a bi-metallic casting by contemplating the removal of an oxide layer from a metal preform, and providing a thin nickel film thereon prior to forming a metallurgical bond between two metal components, such as a metal preform and an overcast metal.

Figure 1:
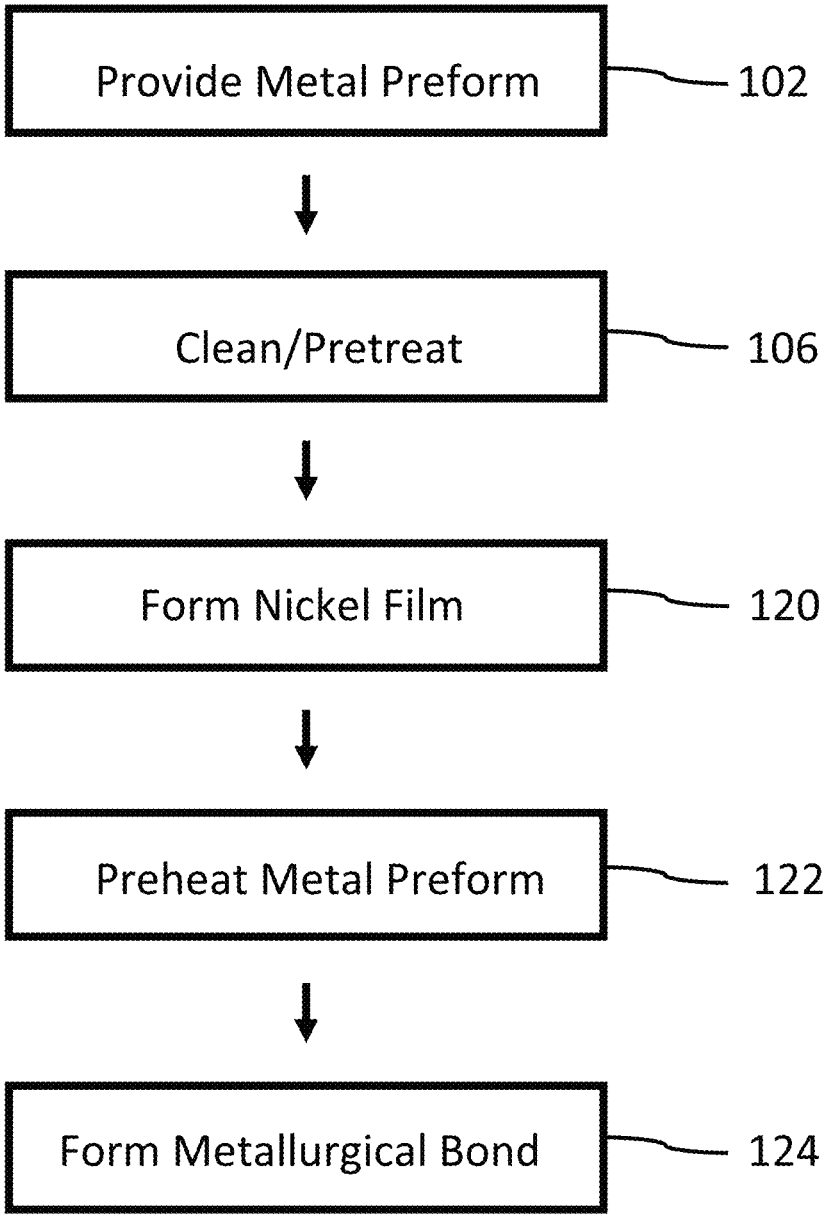
FIG. 1 is a flow diagram illustrating one method of forming a bi-metallic casting according to various aspects of the present disclosure.
Figure 2:
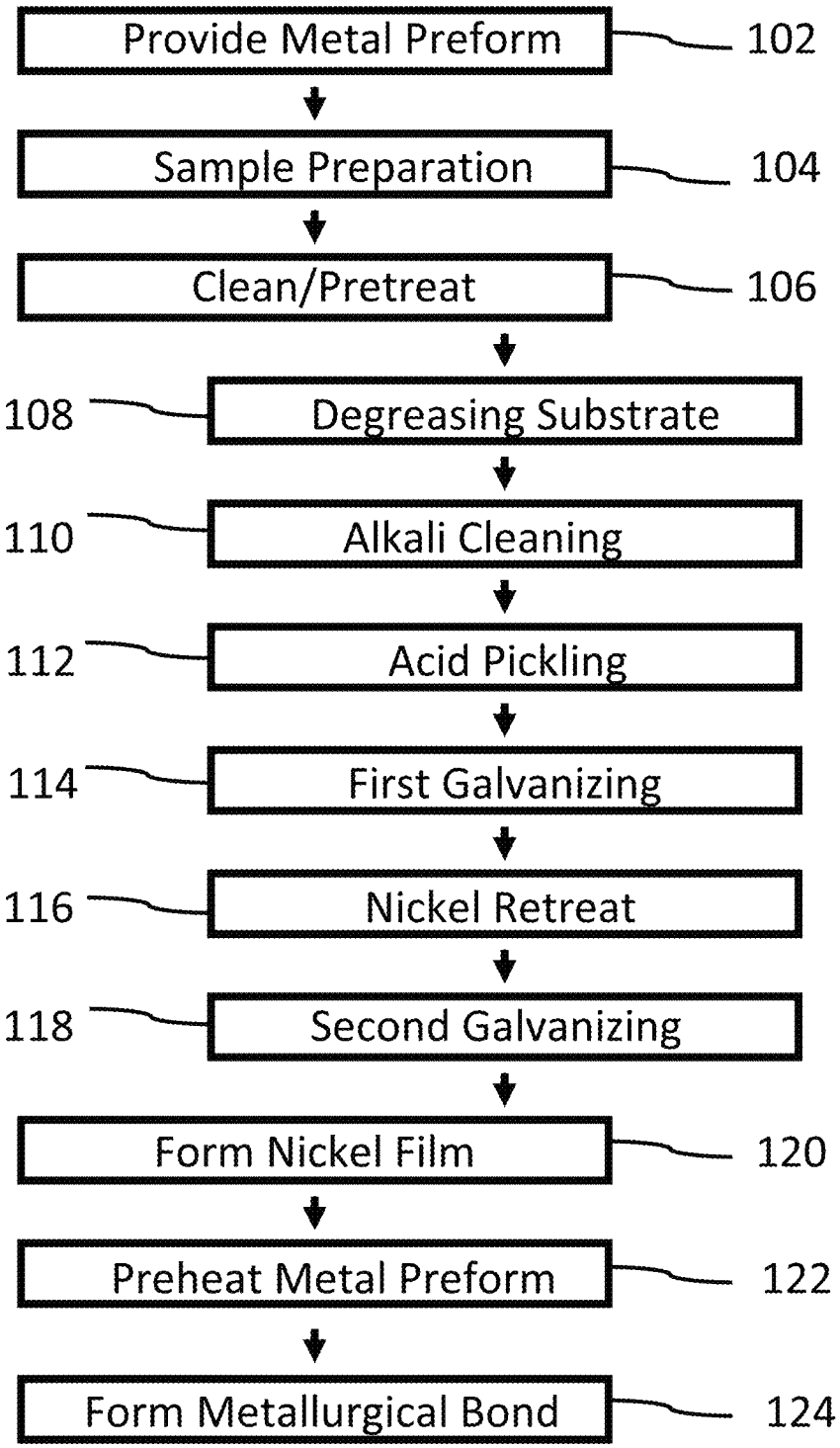
FIG. 2 is a flow diagram illustrating one method of forming a bi-metallic casting according to various aspects of the present disclosure.

With reference to FIGS. 1 and 2, which generally represent steps of various embodiments of the methods used in the present technology, a metal preform is provided in step 102 and may have a desired base shape, size, and configuration for its intended end use. It is envisioned that the present technology may be used to manufacture numerous different kinds of bi-metallic casting components, including non-limiting examples such as engine cradles, instrument panel beams, cast or wrought electric motors, gears, screws and screw barrels, housings, clamps, lugs, and the like. The metal preform may define a substrate surface. As used herein, the term "substrate surface" is generally representative of the outermost or exterior layer, or exposed area of the metal preform. Certain components may have more intricate shapes and features than other components. Accordingly, the size and shape of the metal preform will vary, as will the substrate surface thereof. While the material of the metal preform is not meant to be limited to certain metals, in various aspects, the metal preform may include one or more metal selected from the group including aluminum (Al), magnesium (Mg), iron (Fe), copper (Cu), and alloys and mixtures thereof. It should be understood that the preform may contain certain small amounts of impurities as is known in the art, or other metals in addition to the predominant metals or alloys present. By way of example, the metal preform itself may be a casting, a forging, an extrusion, a stamping, or a spun component. It may be provided as a solid component, or it may be shaped with apertures or gaps, having various thicknesses and cross-sectional areas. The metal preform may be machined or otherwise shaped as desired prior to additional processing.

With reference to step 104, the methods may include sample preparation of the metal preform. Specifically, mechanical polishing of the metal preform may be performed. For example, the metal preform may be polished with 600 grit, 1000 grit, 5000 grit, or other roughness abrasive pad to remove surface debris and/or surface imperfections.

With reference to step 106, the methods may include cleaning and/or pretreating the metal preform, and specifically removing any natural oxide layer that may have formed on the substrate surface(s) in order to yield a cleaned metal preform having a substrate surface substantially free from oxides. As used herein, the term "substantially free" is used to indicate that oxides are not intended to be included on the substrate surface, and that the substrate surface is either free from oxides, that a significant amount of oxides have been removed, and/or the remaining presence of oxides on the substrate surface is only a negligible amount.

As should be understood, various cleaning and degreasing treatments can be used with the present technology and their selection may be based on the condition of the metal preform, as well as the size, shape, and metal content. In certain aspects, the cleaning and oxide removal step 106 may include degreasing the substrate surface in step 108. Numerous degreasing techniques can be used as is known in the art. In one non-limiting example, the metal preform can be treated with a solution of 25 g/L sodium carbonate and 30 g/L trisodium phosphate at 65° C. for 5 minutes, or a time sufficient to meaningfully degrease the metal preform.

Once degreased, the metal preform can be subjected to alkali cleaning treatment in step 110. For example, the substrate surface can be treated with an alkali erosion solution containing about 100 g/L NaOH. The treatment may take place at room temperature of about 30° C., and the substrate surface may be exposed to the solution for a brief time of about 5-10 seconds, 10-15 seconds, 15-20 seconds, 20-25 seconds, or more, as known in the art and based on the desired amount of etching.

The metal preform may also be subjected to an acid pickling process in step 112 to further remove impurities from the substrate surface. In one non-limiting example, the pickle liquor can include an acidic solution containing 100 ml/L sulfuric acid (98 volume %) and 500 ml/L nitric acid (65 volume %). Stronger or more diluted mixtures may also be used where desired. The pickling process may be performed at room temperature of about 30° C. for a brief time of about 5-10 seconds, 10-15 seconds, 15-20 seconds, or longer, as known in the art and based on the desired amount of treatment.

With reference to step 114, a first dip galvanizing treatment may be performed on the metal preform. In one example, a first galvanization bath may be prepared having a mixture commensurate with a solution containing about 50 g/L NaOH (sodium hydroxide), 5 g/L ZnO (zinc oxide), 50 g/L $Na_2C_4H_4O_6$ (sodium tartrate), 2 g/L $FeCl_3$ (ferric chloride), and 1 g/L $NaNO_3$ (sodium nitrate). The metal preform may be subjected to a first immersion in the first galvanization bath for about 40 seconds, for about 50 second, for about 1 minute, or longer, as known in the art and based on the desired amount of treatment, at room temperature of about 30° C. It should be understood that other galvanizing processes may also be used, and the parameters can be altered for the specific metals of the bi-metallic casting.

With reference to step 116, a nickel retreat treatment may be performed on the metal preform. In one example, nitric acid (65 volume %) is provided. The metal preform may be subjected to the nitric acid at room temperature of about 30° C. for about 40 seconds, for about 50 second, for about 1 minute, for about 1 minute and 10 seconds, or longer, as known in the art and based on the desired amount of treatment. To achieve a zinc layer which fully covers the metal preform from the first galvanizing step 114, an extended galvanizing time is utilized. With longer galvanizing time, the zinc layer may be rough with slightly different thicknesses or porosity. Additionally, the grain size of the zinc layer may become coarse from grain growth with the extended galvanizing time. The nickel retreat treatment step 116 removes the rough and loosely bonded zinc layer so that a very thin zinc layer, which is almost undetectable, is left from the first galvanizing step 114. With a starting thin zinc layer, the zinc layer from a second galvanizing step 118 (discussed below) which has a shorter time galvanizing time is more uniform and dense compared with the first galvanizing step 114. Therefore, the nickel retreat treatment step 116 helps improve the quality of the zinc layer from the second galvanizing step 118. The zinc layer exhibits much more uniformity with two galvanizing steps.

With reference to step 118, a second dip galvanizing treatment may be performed on the metal preform. In one example, a second galvanization bath may be prepared having a mixture commensurate with a solution containing about 120 g/L NaOH (sodium hydroxide), 20 g/L ZnO (zinc oxide), 50 g/L Na2C4H4O6 (sodium tartrate), 2 g/L FeCl3 (ferric chloride), and 2 g/L NaNO3 (sodium nitrate). The metal preform may be subjected to a second immersion in the second galvanization bath for about 10 seconds, for about 15 seconds, for about 20 seconds, 25 seconds, or longer, as known in the art and based on the desired amount of treatment, at room temperature of about 30° C. It should be understood that other galvanizing processes may also be used, and the parameters can be altered for the specific metals of the bi-metallic casting.

It is noted that a single galvanizing step may be performed in place of the first galvanizing step 114 and second galvanizing step 118. However, the zinc layer formation with both the first galvanizing step 114 and second galvanizing step 118 is more uniform and dense. At least one galvanizing step is necessary for a uniform nickel electroplating. Without at least one galvanizing step, the subsequent electroplating of nickel is not uniform and some regions may not form any nickel layer.

With reference to step 120, the method proceeds to the formation of a thin nickel film on at least a portion of the substrate surface of the metal preform, preferably a cleaned portion of the metal preform. In many instances, the thin nickel film can be formed over an entirety of the substrate surface. It is envisioned that the nickel film can provide numerous benefits to the bi-metallic casting process. In one aspect, the nickel film is provided over the metal preform having a thickness sufficient to prevent the formation or the re-formation of a natural oxide layer on the substrate surface prior to the subsequent casting and bonding processes.

While not wishing to be bound by any particular theory, it is believed that the thin nickel film is able to improve wetting and thereby promote the metallurgical bonding of the metal preform to the overcast metal to form the bi-metallic casting. Yet, the nickel film is provided with a controlled thickness such that it does not provide enough metal for interfacial bonding in the bi-metallic casting. Thus, in various aspects, the thin nickel film layer may substantially remain on or at the substrate surface of the metal preform as a thin interface layer promoting the metallurgical bonding.

The nickel film may be formed on or applied to all or part of the substrate surface using known techniques in order to form the film or layer having a thickness of less than about 10 μm, preferably less than about 5 μm, less than about 3 μm, and even about 1 μm, in certain aspects.

By way of example, the formation of the nickel film may include electroplating in a nickel solution at room temperature of about 30° C. An exemplary nickel solution is 120 g/L $NiSO_4.6H_2O$, 30 g/L $NiCl_2.6H_2O$, 140 g/L Na3C6H5$O_7$.2$H_2O$, 35 g/L (NH4)2$SO_4$, 30 g/L sodium glucose, 1 g/L Saccharin, and 0.05 g/L lauryl sodium sulfate. Typically the nickel solution has a pH of approximately 7.0. The applied current density of the electroplating may be from about 0.5 to about 5 A/$dm^2$, for example, about 2 A/$dm^2$. The electroplating current may be applied for 1 minute, 3 minutes, 5 minutes, 8 minutes, or longer, as known in the art and based on the desired nickel layer thickness desired. It should be understood that the parameters can be altered as desired in order to form a nickel layer having the appropriate controlled thickness as desired for the specific metals of the bi-metallic casting. During the electroplating, the nickel solution is stirred to avoid absorption of hydrogen from polarization of the aluminum surface.

After the metal preform is cleaned and the metallic film is formed, method step 122 of FIGS. 1 and 2 represents an option of preheating step the metal preform. The optional preheating step may serve to reduce the temperature gradient between the metal preform and the molten casting overcast metal, so as to reduce contraction stresses and/or shrinking in the casting. This may also minimize the potential for any defined bond lines at the casting interface. As is known, the temperature and the time of the preheating step can be varied in order to appropriately allow relaxation time. For example, the metal preform may be heated to between 150 and 350° C., between 125 and 325° C., between 200 and 400° C., or other ranges within the disclosed bounds.

With reference to method step 124, a metallurgical bond is formed between at least a portion or an entirety of the metal preform having the nickel film and an overcast metal to form a bi-metallic casting component. As discussed above, the nickel film may serve to promote the metallurgical bonding between the two metals and, in some aspects, may substantially remain on the substrate surface of the metal preform as an interface between the metals. In non-limiting examples, the overcast metal may include any metal, alloy, or combination thereof suitable for use in metal casting techniques, such as aluminum alloys and magnesium alloys. In various aspects, the selection of the specific overcast metal or alloy may be based on the final shape and configuration or end use of the bi-metallic casting component. The overcast metal may have a composition different from one or both of the metal preform and the nickel film. Where the bi-metallic casting component will have an intricate or complex final shape, a metal or alloy having a high degree of fluidity may be used. Where the bi-metallic casting component will be required to have increased strength, a different metal or alloy will be appropriately chosen.

Figure 3:
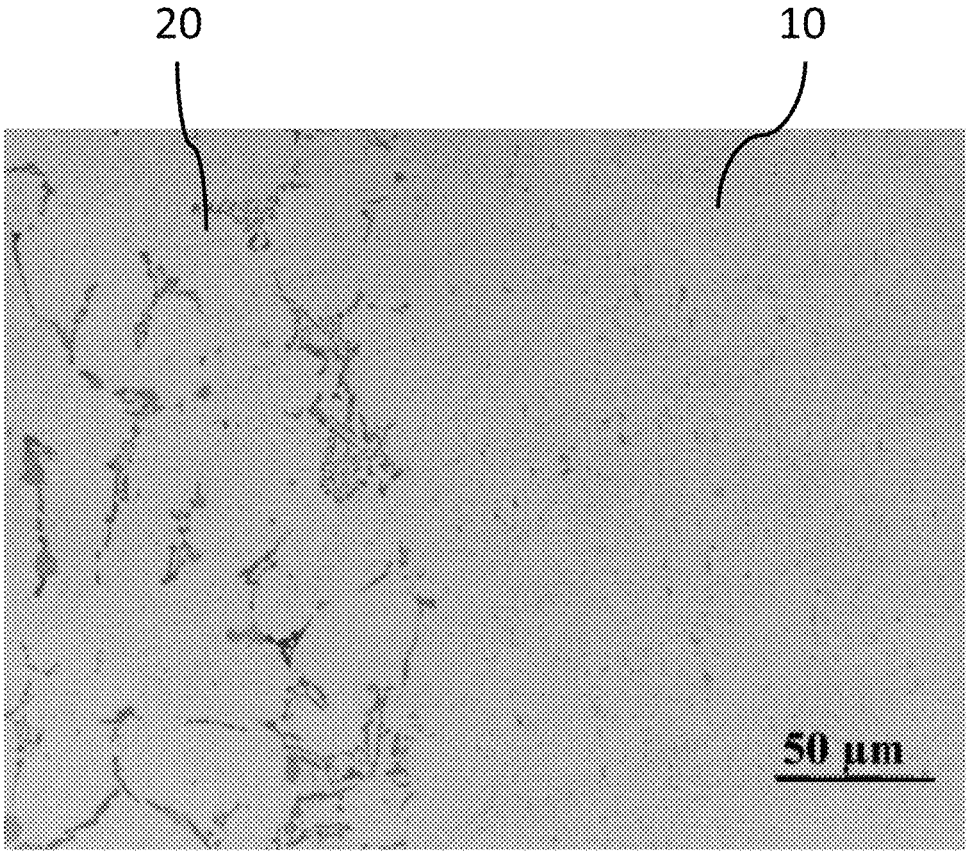
FIG. 3 is a micrograph illustrating the interface between preformed aluminum 6101 alloy bars and cast aluminum alloy A356 according to various aspects of the present disclosure.

With reference to FIG. 3, a micrograph illustrating the interface between the metal preform and the overcast metal to form a bi-metallic casting is provided. Specifically a preformed aluminum 6101 alloy bar 10 as the metal preform and cast aluminum alloy A356 20 as the overcast metal are shown forming a bi-metallic casting with good metallurgical bonding at the interface.

The metallurgical bonding may be carried out by contacting the metal preform with a molten metal via a conventional molten metal casting process as known in the art, for example, using die casting or sand casting techniques. In this regard, the metal preform may be preheated prior to being placed in a suitable mold, or the mold may be equipped with heated die panels as is known in the art. Notably, molten metals, such as aluminum, react with air and instantaneously create oxides. Accordingly, care should be taken when contacting the metal preform with the molten material. Additional exemplary techniques for such bi-metallic casting can be found in U.S. Pat. No. 8,708,425 issued on Apr. 29, 2014 and assigned to GM Global Technology Operations, Inc., the entire specification of which is incorporated herein by reference.

The metallurgical bonding may also be carried out by using squeeze casting techniques. In this regard, the overcast metal is heated above a melting point of the overcast metal is poured over the metal preform. Subsequently, pressure is immediately applied until the casting solidifies. For example, an aluminum A356 alloy overcast metal may be heated to about 680° C. to 720° C., poured over the metal preform, and squeezed with a pressure between about 10 and 80 MPa until the casting solidifies. Currently pending co-owned U.S. patent application Ser. No. 14/739,042 filed Jun. 15, 2015 entitled "Method of making aluminum or magnesium based composite engine blocks or other parts with in-situ formed reinforced phases through squeeze casting or semi-solid metal forming and post heat treatment" addresses squeeze casting and is incorporated by reference herein in its entirety.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

It is noted that terms like "preferably", "generally" and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention, it is noted that the terms "substantially" and "approximately" and their variants are utilized herein to represent the inherent degree of uncertainty that may be attributed to any quantitative comparison, value, measurement or other representation. The term "substantially" is also utilized herein to represent the degree by which a quantitative representation may vary from a stated reference without resulting in a change in the basic function of the subject matter at issue.

Having described the invention in detail and by reference to specific embodiments, it will nonetheless be apparent that modifications and variations are possible without departing from the scope of the invention defined in the appended claims. In particular it is contemplated that the scope of the present invention is not necessarily limited to stated preferred aspects and exemplified embodiments, but should be governed by the appended claims.

What is claimed is:

1. A method of forming a bi-metallic casting, the method comprising:

providing a metal preform of a desired base shape defining a substrate surface;

removing an oxide layer and surface contamination from the substrate surface, yielding a cleaned metal preform;

galvanizing the cleaned metal preform, yielding a galvanized metal preform;

electroplating a thin nickel film on at least a portion of the substrate surface of the galvanized metal preform; and metallurgically bonding the portion of the metal preform having the nickel film with an overcast metal to form a bi-metallic casting, wherein the nickel film promotes a metallurgical bond between the metal preform and the overcast metal.

2. The method of claim 1, further comprising preheating the metal preform having the nickel film prior to metallurgically bonding the metal preform with the overcast metal.

3. The method of claim 1, comprising providing the nickel film having a thickness sufficient to prevent a re-formation of the oxide layer.

4. The method of claim 3, wherein the nickel film is formed having a thickness of about 1 μm to about 5 μm.

5. The method of claim 1, wherein removing the oxide layer from the substrate surface comprises:

degreasing the substrate surface;

treating the substrate surface with an alkali etching solution; and pickling the substrate surface.

6. The method of claim 1, wherein galvanizing the cleaned metal preform comprises:

treating the substrate surface with a zinc galvanizing solution;

treating the substrate surface with nitric acid; and treating the substrate surface a second time with a zinc galvanizing solution.

7. The method of claim 1, wherein metallurgically bonding the portion of the metal preform having the nickel film with the overcast metal comprises a metal casting process using a molten metal.

8. The method of claim 7, wherein the overcast metal is an aluminum alloy which is heated to between 680° C. and 740° C.

9. The method of claim 8, wherein the metal casting process comprises squeeze casting.

10. The method of claim 1, wherein the metal preform comprises an aluminum alloy.

11. The method of claim 1, wherein the overcast metal comprises an aluminum alloy.

12. The method of claim 1, wherein the nickel film is formed on an entirety of the substrate surface, and the overcast metal is metallurgically bonded to an entirety of the metal preform.

13. A method of forming a bi-metallic casting with improved bonding between metal components, the method comprising:

providing an aluminum preform of a desired base shape defining a substrate surface;

removing a natural oxide layer from the substrate surface;

etching the substrate surface;

galvanizing the substrate surface;

electroplating a thin nickel film on the substrate surface;

preheating the aluminum preform to 150° C. to 350° C.; and forming a metallurgical bond between at least a portion of the aluminum preform and an overcast metal having a composition different from both the aluminum preform and the nickel film, wherein the nickel film promotes the metallurgical bond between the aluminum preform and the overcast metal.

14. The method of claim 13, wherein the nickel film is formed having a thickness of less than about 5 μm.

15. The method of claim 12, wherein removing the natural oxide layer from the substrate surface comprises degreasing the substrate surface prior to etching the substrate surface.

16. The method of claim 15, wherein etching the substrate surface comprises treating the substrate surface with an alkali etching solution followed by pickling the substrate surface.

17. The method of claim 13, wherein galvanizing the substrate surface comprises:

treating the substrate surface with a zinc galvanizing solution;

treating the substrate surface with nitric acid; and treating the substrate surface a second time with a zinc galvanizing solution.

18. A method of forming a bi-metallic casting with an aluminum preform, the method comprising:

removing a natural oxide layer from a surface of an aluminum preform;

immersing the aluminum preform into a galvanizing bath;

electroplating a thin nickel film having a thickness of less than about 5 μm on the surface of the aluminum preform;

preheating the aluminum preform to 150° C. to 350° C.; and contacting at least a portion of the aluminum preform with a molten aluminum heated to between 680° C. and 740° C. to form a bi-metallic casting, wherein the nickel film substantially remains on the surface of the aluminum preform as an interface promoting a metallurgical bond between the aluminum preform and the molten aluminum.

* * * * *